United States Patent [19]

Andreasson et al.

[11] Patent Number: 4,648,375

[45] Date of Patent: Mar. 10, 1987

[54] CAPACITOR IGNITION SYSTEM

[75] Inventors: Bo C. Andreasson, Göteborg; Sven I. Faijersseon, Kållered, both of Sweden

[73] Assignee: AB Electrolux, Sweden

[21] Appl. No.: 730,433

[22] Filed: May 3, 1985

[30] Foreign Application Priority Data

May 11, 1984 [SE] Sweden ..... 8402557

[51] Int. Cl.[4] ..... F02P 5/15

[52] U.S. Cl. ..... 123/602; 123/417

[58] Field of Search ..... 123/602, 149 C, 415, 123/416, 417

[56] References Cited

U.S. PATENT DOCUMENTS 4,306,536 12/1981 Fitzner ..... 123/602

4,378,769 4/1983 Haubner et al. ..... 123/416

4,515,118 5/1985 Haubner et al. ..... 123/149 C

*Primary Examiner*—Andrew M. Dolinar

*Attorney, Agent, or Firm*—Alfred E. Miller

[57] ABSTRACT

A capacitor ignition system of magnet type comprises a charging winding (10), a trigger winding (11), an ignition coil (13) and an ignition switch (14) with electronic control means, in this case a micro-processor (16). For practical, economical reasons the voltage of the charging winding cannot be used for current supply to the electronic control means as this voltage is several hundred volts. In the trigger winding the chosen voltage can be a few volts which is a proper voltage for the control means. The trigger winding of the invention has double functions: to generate a reference voltage for spark release (triggering) and to be an energy source for the electronic control means.

7 Claims, 3 Drawing Figures

CAPACITOR IGNITION SYSTEM

The present invention relates to an ignition system for an i.c. engine according to the principle of a capacitor discharging through an ignition switch and a coil.

Ignition systems of small engines are mainly constituted of electronic magnet systems with two or three poles inducing positive and negative pulses in a primary winding. In the simplest arrangement the positive pulse is used both for charging magnetic energy for inducing the ignition voltage and for the current supply of the electronic control circuits. However, a magnet system is disadvantageous in that the control range of the ignition advance is limited to about 15 degrees. Another disadvantage is found in that the ignition energy decreases when the pulse is used both for the spark and the control circuits.

A large control range of the ignition advance is required for big engines. Moreover, the energy content of the negative pulses of the system herein is sufficient for supplying the electronic control means so that the whole positive pulse can be used as ignition energy. Owing to this the impedance of the supply unit can be low so that capacitors in this unit are rapidly charged, which means that the electronic control means can start working at the first pulse. This is a necessity for a rope or kick start of the engine.

The drawbacks of the magnet ignition systems are eliminated by so-called capacitor ignition systems in which the capacitor is charged by pulses from a magnet system and discharged by triggering an ignition switch. Since the charging circuit now has a rather high voltage (300–400 V), an extra winding for the supply of the electronic control means is provided. In the present invention these means include a micro-processor i.a. for the control of the ignition advance. The extra winding has also the function of suppyling reference pulses for the control of the ignition advance. Thanks to the separated supply systems for spark generation and electronic control means by double windings in the magnet system and the use of one type of induced pulses for spark energy and the other type for the electronic means a rapid setting into work of the system can be achieved so that start of the engine is facilitated.

Figure 1:
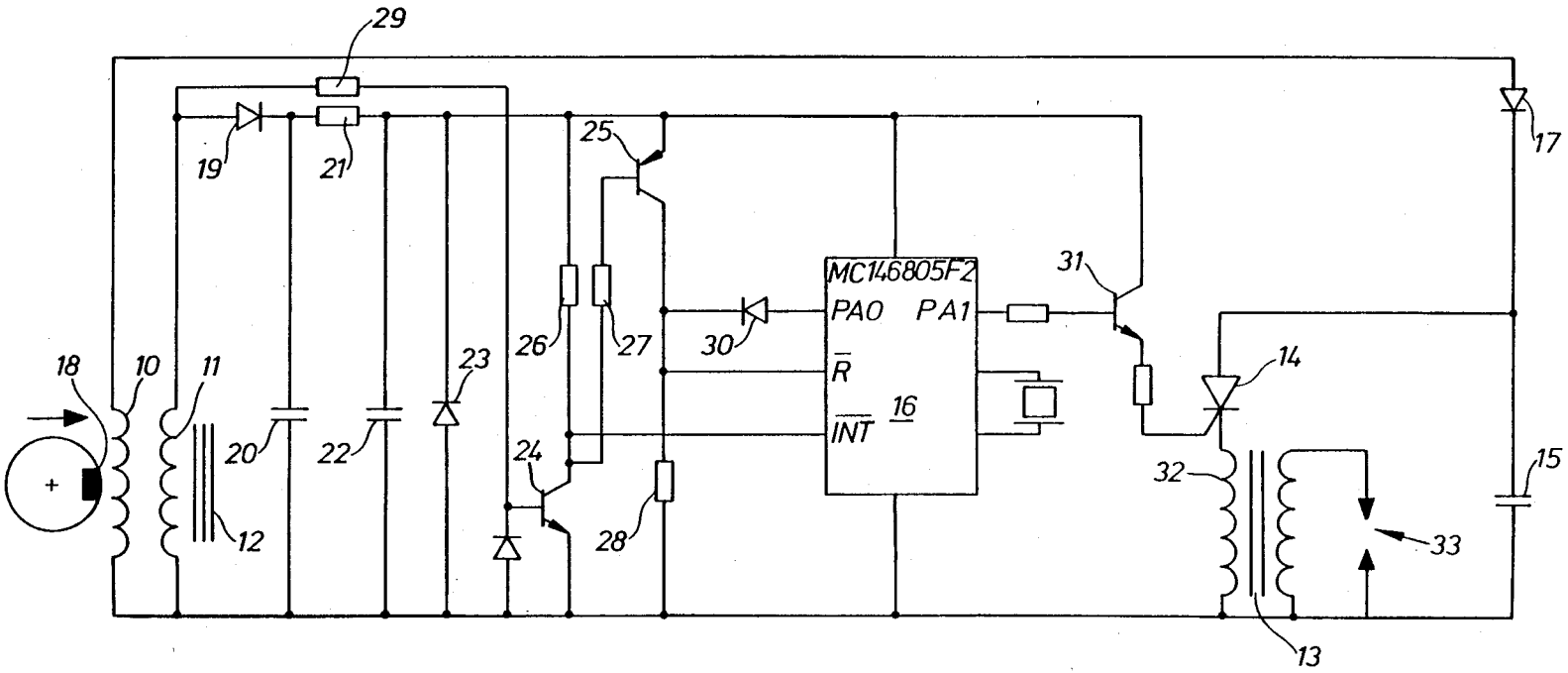
Figure 2:
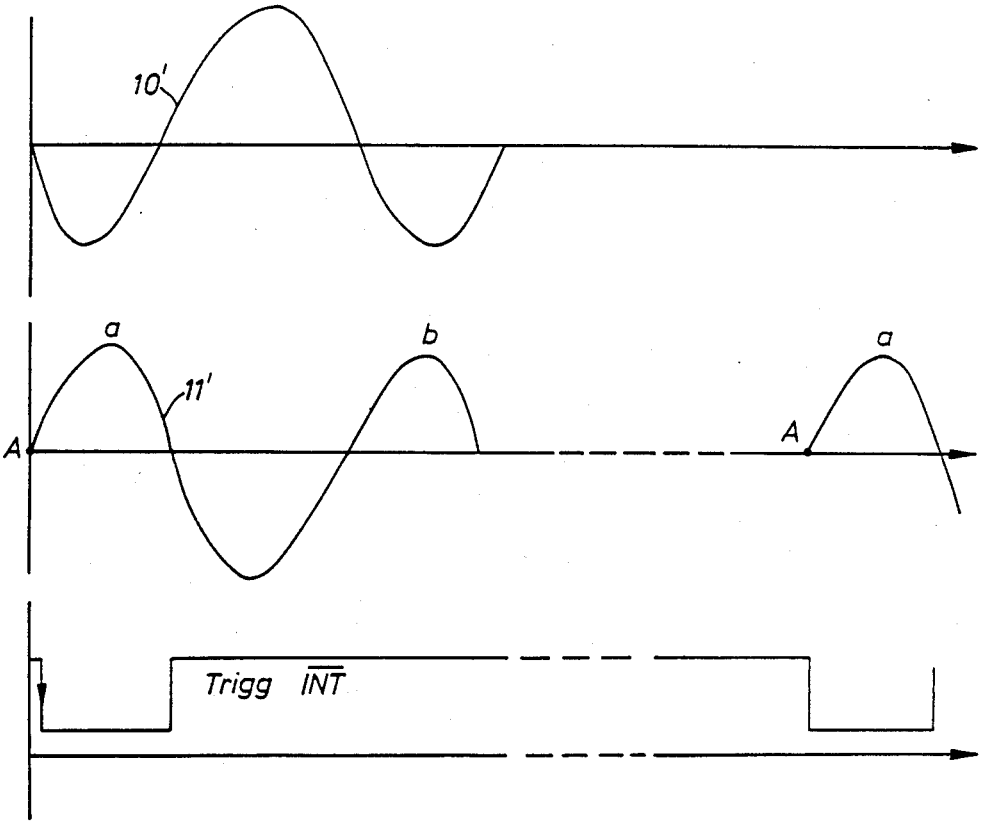
Figure 3:
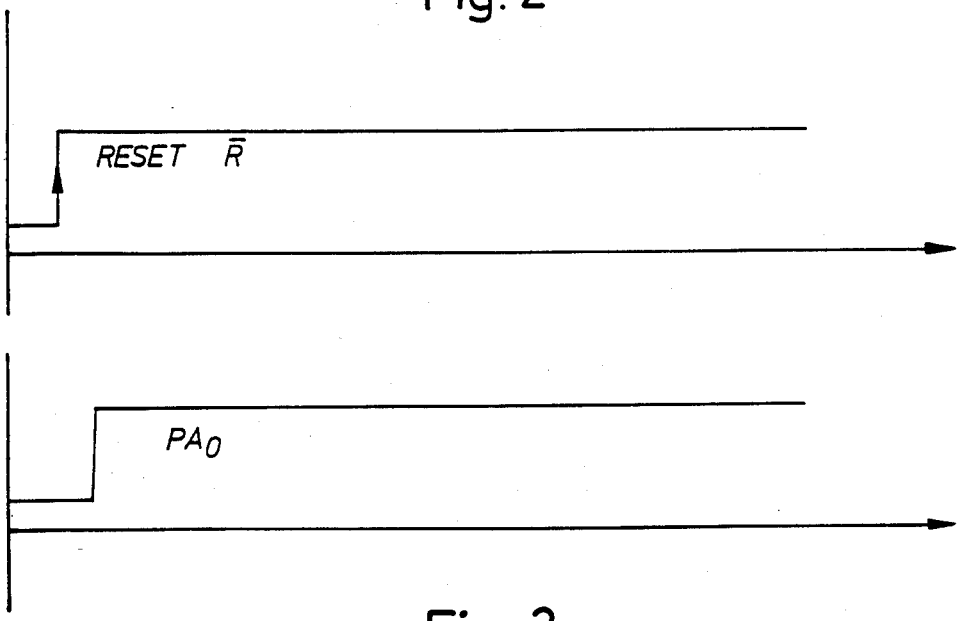

An embodiment of the invention will now be described in the following paragraphs with reference to the accompanying drawings which show in FIG. 1 is a wiring diagram of the ignition system, FIG. 2 a voltage curve and trigger pulses, FIG. 3 reset and output of the micro-processor.

A capacitor ignition system of the magnet type comprises components according to FIG. 1, the main parts of which are: a charging winding 10, a trigger winding 11 on an iron core 12, an ignition coil 13, an ignition switch 14, an ignition capacitor 15 and a micro-processor 16. The charging winding 10 charges the capacitor 15 via a diode 17 when a permanent magnet 18 positioned on a flywheel passes the iron core. The winding 11 has a winding direction which is opposite (that of 10) and supplies pulses of opposite polarity (see the curves 10' and 11' in FIG. 2). When the magnet passes the core the first pulse from the winding 11 is therefore positive and charges a capacitor 20 via a diode 19, the capacitor 20 being connected to a smoothing circuit with a resistor 21 and a capacitor 22. A Zener-diode 23 stabilizes the voltage from the smoothing circuit and the voltage is transferred to a transistor amplifier with the transistors 24, 25 and the resistors 26, 27, 28.

As said hereinbefore the pulses from the winding 11 are used as reference signals to the micro-processor. The pulse is fed via a resistor 29 to the base of the transistor 24 where the signal is amplified and fed to the input "interrupt" of the processor. The shape of the pulse on the input is shown at the bottom of FIG. 2. In the next amplifier step, i.e. the transistor 25, the pulse is phase-inverted and amplified and fed to the input "reset" of the processor. For completeness it shall be noted that another input $PA_0$ via a diode 30 is connected to the collector of the transistor. These connections to the processor are necessary to make it cooperate in a start routine during which the engine speeds up from 0 to about 2000 r.p.m. As shown in FIG. 2 there are two pulses a, b each time the magnet passes the core, but only the first one is of interest for triggering and releasing the spark. The second pulse b shall be removed at the input of the processor the "interrupt" of which is provided with a latch in which the pulse is stopped because of high level of voltage at the input during an interval $T_{180}$ corresponding to the time of half a revolution of the engine. In the present case $T_{180}$ is about 1/40 second, i.e. half the time of a revolution at 1200 r.p.m. This time is sufficient to overlap the time T between a and b at all r.p.m. during the start routine. Without this routine the processor would release a spark at the pusle b which would be wrong as the available charge of the capacitor 15 shall give a spark first at the command of the next pulse a. The release of a spark is obtained by way of the processor by a pulse on its output $PA_1$ to the base of a transistor 31 which is connected to the control electrode of the ignition switch 14. The capacitor 15 is short-circuited through the primary winding 32 of the ignition coil 13 which by its secondary winding gives ignition voltage to the spark plug 33. In short, an ignition procedure in the micro-processor takes place as outlined in the following:

The input to which the signal from the transistor 24 is supplied is scanned and the time A is stored as a reference time. The storing is possible since the micro-processor has a timer running at a fixed frequency. At every reference time the number of time pulses occurring after the preceding reference time are registered. The number of pulses counted corresponds to a rotation of 360° of the crankshaft. By dividing the number of pulses between the reference times A—A by a predetermined number, e.g. 16, a number remains which corresponds to an ignition advance of 360/16=22.5°. This number is called the reference number and is a memory data stored in a static memory of the processor. The reference number can be dependent on the r.p.m. and is inversely proportional at low r.p.m. When the number of time pulses reaches the reference number the ignition is initiated via the output $PA_1$. The timer is set to zero every time a reference time passes and the counting to the reference number takes place for every spark. At low r.p.m. the ignition occurs with a constant ignition advance. At higher r.p.m. the reference number is dependent in another way on the r.p.m. with a corresponding change of the ignition advance. The number of time pulses between A—A is then a direct or an indirect address to a position in the memory of the processor, where the reference number corresponding to the ignition advance is stored. The entire function of the processor can also be achieved by means of standard modules in CMOS technology, as shown in Swedish Patent Publication No. 8205901-5. In practice, however, the processor has a lot of advantages which make the assembly of modules unrealistic, which is the reason why only the arrangement with a processor has been described here. A processor of the brand "Motorola" denoted on the drawing is considered appropriate.

We claim:

1. A capacitor discharge system for an internal combustion engine, comprising a magnetic charging system including a first winding on an iron core, a capacitor, means coupling said capacitor to said first winding, magnet means movable with respect to said core in synchronization with the rotation of said engine for generating a voltage in said first winding for charging said capacitor via said coupling means, an ignition coil having a primary winding and a secondary winding for producing an ignition voltage adapted to be applied to a spark plug, an ignition switch coupled to discharge said capacitor through said primary winding, a logic circuit connected to energize said ignition switch, a second coil on said core, rectifier means and filter circuit means coupled to said second coil for generating an operating voltage, means applying said operating voltage to said logic circuit, an amplifier connected to said logic circuit, said amplifier being coupled to said second coil for applying a reference position signal to said logic circuit of the rotation of said engine, said logic circuit comprising means for controlling the time of energization of said ignition switch for controlling the spark advance of said engine.

2. The capacitor discharge system of claim 1 wherein said rectifier means is poled to pass current and said second coil is poled to produce said reference signal in the first half wave of energy generated in said second coil at each passage of said magnet means past said iron core.

3. The capacitor discharge system of claim 2 wherein said first coil is connected to apply current to said capacitor during the second half wave of energization in said first coil at each passage of said magnet means past said iron core.

4. The capacitor discharge system of claim 1 wherein said logic circuit comprises a microprocessor.

5. The capacitor discharge system of claim 4 wherein said amplifier comprises means for applying relatively inverted first and second outputs to interrupt and reset inputs respectively of said microprocessor.

6. The capacitor discharge system of claim 1 wherein said first and second coils have opposite winding directions.

7. The capacitor discharge system of claim 4 wherein said microprocessor comprises a terminal connected to the output of said amplifier, and latch means for inhibiting reception of a second signal from said amplifier for a determined time following the reception of a first signal therefrom, whereby said microprocessor is responsive to only one signal at said terminal for each revolution of said engine.

* * * * *